US009854631B2

(12) United States Patent
Akiyama et al.

(10) Patent No.: US 9,854,631 B2
(45) Date of Patent: Dec. 26, 2017

(54) LED ILLUMINATION DEVICE

(71) Applicants: CITIZEN ELECTRONICS CO., LTD., Fujiyoshida-shi, Yamanashi (JP); CITIZEN HOLDINGS CO., LTD., Tokyo (JP)

(72) Inventors: Takashi Akiyama, Sayama (JP); Yuki Ochiai, Yamanashi (JP)

(73) Assignees: CITIZEN ELECTRONICS CO., LTD, Yamanashi (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 15/126,440

(22) PCT Filed: Mar. 17, 2015

(86) PCT No.: PCT/JP2015/057918
§ 371 (c)(1),
(2) Date: Sep. 15, 2016

(87) PCT Pub. No.: WO2015/141685
PCT Pub. Date: Sep. 24, 2015

(65) Prior Publication Data

US 2017/0086265 A1 Mar. 23, 2017

(30) Foreign Application Priority Data

Mar. 17, 2014 (JP) ..... 2014-053284

(51) Int. Cl.
*H05B 33/00* (2006.01)
*H05B 33/08* (2006.01)

(52) U.S. Cl.
CPC ..... *H05B 33/083* (2013.01); *H05B 33/0815* (2013.01); *H05B 33/0827* (2013.01); *H05B 33/0845* (2013.01)

(58) Field of Classification Search
CPC ..... H05B 33/0815; H05B 33/0845; H05B 33/083; H05B 33/0809; H05B 33/0824;
(Continued)

(56) References Cited

U.S. PATENT DOCUMENTS

2014/0184086 A1 7/2014 Lee et al.

FOREIGN PATENT DOCUMENTS

CN 203219546 U 9/2013
JP 2010232053 10/2010
(Continued)

OTHER PUBLICATIONS

International Search Report and Written Opinion for International Application No. PCT/JP2015/057918, dated May 26, 2015, 5 pages.
(Continued)

*Primary Examiner* — Monica C King
(74) *Attorney, Agent, or Firm* — RatnerPrestia

(57) ABSTRACT

An LED illuminator configured to further reduce total harmonic distortion is provided. The LED illuminator has: a first LED string including a first partial LED string and a second partial LED string; a second LED string including a third partial LED string and a fourth partial LED string; a first switching circuit configured to switch between a state where only the first partial LED string is connected to a rectifier and a state where the first partial LED string and the second partial LED string connected in series are connected to the rectifier as a full-wave rectified voltage waveform that is output from the rectifier increases/decreases; and a second switching circuit configured to switch between a state where only the third partial LED string is connected to the rectifier and a state where the third partial LED string and the fourth partial LED string connected in series are connected to the rectifier, and the switching timing by the first switching
(Continued)

circuit and the switching timing by the second switching circuit are set so as to differ from each other.

10 Claims, 13 Drawing Sheets

(58) Field of Classification Search
CPC ..... H05B 33/0851; H05B 33/0827; H05B 33/0812; H05B 33/0818; H05B 33/089; H05B 37/02; H05B 33/0803; H05B 33/0821; H05B 33/08
See application file for complete search history.

(56) References Cited

FOREIGN PATENT DOCUMENTS

| | | | | | |
|---|---|---|---|---|---|
| JP | | 2013502081 | | 1/2013 | |
| NL | WO | 2013027171 | A1 * | 2/2013 | ..... H05B 33/083 |
| WO | | 2013027171 | | 2/2013 | |

OTHER PUBLICATIONS

Extended European Search Report for European Application No. 15764137.4, dated Sep. 26, 2017, 5 pages.

* cited by examiner

LED ILLUMINATION DEVICE

CROSS-REFERENCE TO RELATED APPLICATIONS

This is the U.S. National Phase application of PCT/JP2015/057918, filed Mar. 17, 2015, which claims priority to Japanese Patent Application No. 2014-053284, filed Mar. 17, 2014, the disclosures of each of these applications being incorporated herein by reference in their entireties for all purposes.

TECHNICAL FIELD

The present invention relates to an LED illuminator including an LED drive circuit configured to drive an LED with a full-wave rectified waveform.

BACKGROUND ART

There is known an LED illuminator including an LED drive circuit having an LED string in which a plurality of LEDs is connected in series and configured to improve luminance and to prevent a flicker by increasing/decreasing the number of serial stages of the LED string in accordance with an increase/decrease in the voltage of the full-wave rectified waveform and by lengthening an on-state period. Among such LED drive circuits, there is an LED drive circuit configured to improve a power factor and a distortion factor by increasing/decreasing a current that flows through the LED string in accordance with an increase/decrease in the full-wave rectified waveform.

FIG. 11 is a circuit diagram of a light source circuit 2600 described in Patent Document 1. The light source circuit 2600 includes a bridge rectifier 2605 and an LED string. The LED string includes an LED group 2601, an LED group 2602, and an LED group 2603, in each of which a plurality of LEDs is connected in series. The light source circuit 2600 further includes a bypass circuit 2610 configured to operate so as to decrease an effective forward turn-on voltage. The bypass circuit 2610 includes resistors R2 and R3, an enhancement type field effect transistor Q1, and a bipolar transistor Q2.

With reference to FIG. 12, a relationship between a current and a voltage of the light source circuit 2600 is explained. FIG. 12A is a waveform diagram illustrating a relationship between a full-wave rectified voltage waveform V1 corresponding to one period and a time t in the light source circuit 2600 and FIG. 12B is a waveform diagram illustrating a relationship between a circuit current I and the time t of the light source circuit 2600. The scales of the time axis are the same in FIG. 12A and FIG. 12B.

During a period of time t30 during which the voltage of the full-wave rectified voltage waveform V1, which is an output of the bridge rectifier 2605, is less than a threshold voltage (effective forward turn-on voltage) determined by the LED groups 2601 and 2602 in the light source circuit 2600, the current I does not flow through the LED groups 2601 and 2602. During a period of time t31 during which the voltage of the full-wave rectified voltage waveform V1 is greater than or equal to the threshold voltage determined by the LED groups 2601 and 2602 and less than a threshold voltage of the LED string, the current I flows through the bypass circuit 2610 from the LED groups 2601 and 2602. At this time, the bypass circuit 2610 performs a constant-current operation with a current value I31. During a period of time t32 during which the voltage value of the full-wave rectified voltage waveform V1 is greater than or equal to the threshold voltage of the LED string, a current flows through an LED group 3 from LED groups 1 and 2. At this time, if a current with a predetermined value or more flows into the bypass circuit 2610 from the right terminal of the resistor R1, the field effect transistor Q1 cuts off and all the current I comes to flow through the LED group 2603. In this case, the current that flows through the resistor R2 is ignored. When the voltage of the full-wave rectified voltage waveform V1 decreases, the processes take place in the opposite order.

As described above, the light source circuit 2600 has an LED string in which a plurality of LEDs is connected in series and increases/decreases the current I that flows through the LED string in accordance with an increase/decrease in the full-wave rectified voltage waveform V1 as well as increasing/decreasing the number of serial stages of the LED string in accordance with an increase/decrease in the full-wave rectified voltage waveform V1. As a result of this, an attempt to improve the luminance, the flicker, the power factor, and the distortion factor is made to a certain extent.

PRIOR ART DOCUMENT

Patent Document

Patent Document 1: Japanese Unexamined Patent Application Publication No. 2013-502081

SUMMARY OF THE INVENTION

The waveform of the current I illustrated in FIG. 12B is made to resemble a sinusoidal wave, but the current I has large modified portions in the form of a ladder, and therefore, the current I considerably differs from a sinusoidal wave. Consequently, in the light source circuit 2600, harmonic noise occurs and the total harmonic distortion (THD) is not reduced sufficiently. That is, there is a possibility that the light source circuit 2600 affects the outside by the harmonic noise when driving with a large current although the influence on the outside is small when driving with a small current.

The objective of the invention of the application is to provide an LED illuminator capable of further reducing the total harmonic distortion.

An LED illuminator has a rectifier, a first LED string connected to the rectifier and including a first partial LED string and a second partial LED string connected in series with the first partial LED string, a second LED string connected to the rectifier in parallel to the first LED string and including a third partial LED string and a fourth partial LED string connected in series with the third partial LED string, a first switching circuit configured to switch between a state where only the first partial LED string is connected to the rectifier and a state where the first partial LED string and the second partial LED string connected in series are connected to the rectifier as a full-wave rectified voltage waveform that is output from the rectifier increases/decreases, and a second switching circuit configured to switch between a state where only the third partial LED string is connected to the rectifier and a state where the third partial LED string and the fourth partial LED string connected in series are connected to the rectifier as the full-wave rectified voltage waveform that is output from the rectifier increases/decreases, and the switching timing by the first switching circuit and the switching timing by the second switching circuit are set so as to differ from each other.

In the above-described LED illuminator, it is preferable for the first switching circuit to detect a current that flows through at least part of the first LED string and to switch between a state where only the first partial LED string is connected to the rectifier and a state where the first partial LED string and the second partial LED string connected in series are connected to the rectifier in accordance with the detected current.

In the above-described LED illuminator, it is preferable for the first switching circuit to have current detection resistors for detecting a current for each of the first partial LED string and the second partial LED string.

In the above-described LED illuminator, it is preferable for the first switching circuit to have one current detection resistor for detecting a current for the first partial LED string and the second partial LED string.

In the above-described LED illuminator, it is preferable for the first switching circuit to detect a voltage of a full-wave rectified voltage waveform that is output from the rectifier and to switch between a state where only the first partial LED string is connected to the rectifier and a state where the first partial LED string and the second partial LED string connected in series are connected to the rectifier in accordance with the detected voltage.

In the above-described LED illuminator, it is preferable for a combination of the number of LEDs included in the first partial LED string and the number of LEDs included in the second partial LED string to be set so as to differ from a combination of the number of LEDs included in the third partial LED string and the number of LEDs included in the fourth partial LED string.

In the above-described LED illuminator, it is preferable for the number of serial stages of LEDs included in the partial LED string that lights up during the period of time during which the voltage of the full-wave rectified voltage waveform is the lowest between the first partial LED string and the second partial LED string to be set so as to differ from the number of serial stages of LEDs included in the partial LED string that lights up during the period of time during which the voltage of the full-wave rectified voltage waveform is the lowest between the third partial LED string and the fourth partial LED string.

In the above-described LED illuminator, it is preferable for the first LED string to further include another partial LED string and for the second LED string to further include another partial LED string.

In the above-described LED illuminator, it is preferable for the number of partial LED strings included in the first LED string to be set so as to differ from the number of partial LED strings included in the second LED string.

In the above-described LED illuminator, it is preferable for the first LED string and the first switching circuit to be configured as one LED module and for the second LED string and the second switching circuit to be configured as another LED module.

In the above-described LED illuminator, the switching timing of the connection state of the first LED string by the first switching circuit and the switching timing of the connection state of the second LED string by the second switching circuit are set so as to differ from each other, and therefore, it is made possible to further reduce the total harmonic distortion.

In the LED illuminator including an LED drive circuit configured to increase/decrease the number of serial stages within an LED string and a current that flows through the LED string as a voltage of a full-wave rectified waveform increases/decreases, the LED illuminator includes: a first LED drive circuit including a first LED string in which a plurality of LEDs is connected in series and configured to increase/decrease the number of serial stages of LEDs included in the first LED string in accordance with the voltage of the full-wave rectified waveform; and a second LED drive circuit including a second LED string in which a plurality of LEDs is connected in series and configured to increase/decrease the number of serial stages of LEDs included in the second LED string in accordance with the voltage of the full-wave rectified waveform, and the first LED drive circuit and the second LED drive circuit are connected in parallel, and the timing at which the number of serial stages of the first LED string switches and the timing at which the number of serial stages of the second LED string switches are different.

The above-described LED illuminator has the first and second LED drive circuits configured to increase/decrease the number of serial stages within the LED string and the current that flows through the LED string as the voltage of the full-wave rectified waveform increases/decreases. The first and second LED drive circuits have the first and second LED strings, respectively and the timing at which the number of serial stages of the first LED string switches in accordance with the change in the voltage of the full-wave rectified waveform and the timing at which the number of serial stages of the second LED string switches are made to differ from each other. In the LED illuminator, a current that is the sum of the current flowing through the first LED string and the current flowing through the second LED string flows and this current changes at small steps in accordance with the change in the voltage of the full-wave rectified waveform. That is, as a result of the current waveform becoming closer to a sinusoidal wave, the total harmonic distortion is reduced.

In the LED illuminator, it is preferable for the combination relating to the number of serial stages of a partial LED string obtained by dividing the first LED string and the combination relating to the number of serial stages of a partial LED string obtained by dividing the second LED string to differ from each other.

In the LED illuminator, the number of serial stages of the partial LED string that is included in the first LED string and which lights up during the period of time during which the voltage of the full-wave rectified waveform is the lowest and the number of serial stages of the partial LED string that is included in the second LED string and which lights up during the period of time during which the voltage of the full-wave rectified waveform is the lowest may be different from each other.

In the LED illuminator, the first and second LED drive circuits may each include only one current detection resistor and the numbers of serial stages of the first and second LED drive circuits may be switched based on the voltage between both ends of the current detection resistor or the divided voltage thereof.

In the LED illuminator, it may also be possible for the first and second LED drive circuits to switch the numbers of serial stages of the first and second LED strings by measuring the voltage of the full-wave rectified waveform.

The purpose and the effect of the present invention will be recognized and obtained by using components that are pointed out particularly in the claims and combinations thereof. Both the foregoing general explanation and the following detailed explanation are merely illustrative and explanatory and do not limit the present invention described particularly in the claims.

EMBODIMENTS OF THE INVENTION

Hereinafter, with reference to the drawings, embodiments of an LED illuminator according to the present invention are described in detail. However, it should be noted that the technical scope of the present invention is not limited to those embodiments but encompasses the inventions described in the claims and the equivalents thereof. The dimension in each drawing does not reflect the exact dimension and sometimes the size of parts is drawn in an exaggerated manner or some parts are omitted for explanation. The same numerals are attached to the same elements and duplicated explanation is omitted.

Figure 1:
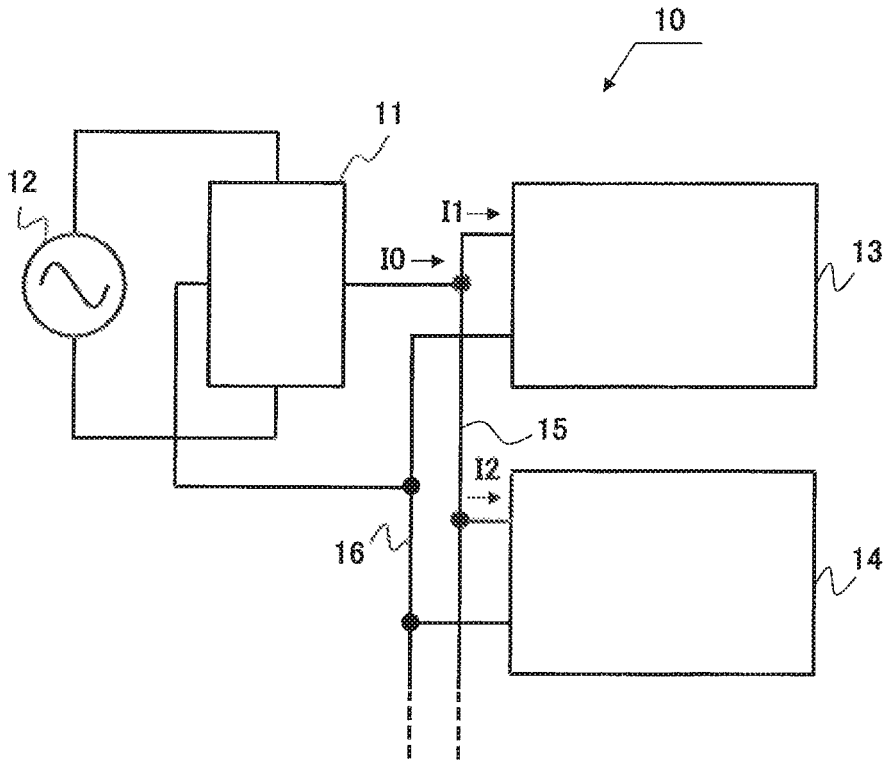
FIG. 1 is a block diagram of an LED illuminator 10.

FIG. 1 is a block diagram of an LED illuminator 10.

As illustrated in FIG. 1, the LED illuminator 10 includes a bridge rectifier circuit 11, a first LED drive circuit 13, and a second LED drive circuit 14. For convenience, in FIG. 1, a commercial AC power source 12 connected to the bridge rectifier circuit 11 is illustrated.

The commercial AC power source 12 connects to the input terminal of the bridge rectifier circuit 11. The bridge rectifier circuit 11 applies a full-wave rectified waveform to the first and second LED drive circuits 13 and 14 via a wire 15. As a result of this, a current I0 is output from the bridge rectifier circuit 11 and currents I1 and I2 flow into the first and second LED drive circuits 13 and 14, respectively. From the first and second LED drive circuits 13 and 14, the currents return to the bridge rectifier circuit 11 via a wire 16. That is, the wire 16 is a ground wire.

The first LED drive circuit 13 includes a first LED string in which a plurality of LEDs is connected in series and the number of serial stages of LEDs included in the first LED string increases/decreases in accordance with the voltage of the full-wave rectified waveform. Similarly, the second LED drive circuit 14 also includes a second LED string in which a plurality of LEDs is connected in series and the number of serial stages of LEDs increases/decreases in accordance with the voltage of the full-wave rectified waveform.

The currents I1 and I2 that flow through the first and second LED drive circuits 13 and 14 also increase/decrease in accordance with the full-wave rectified waveform, but the timing at which the number of serial stages of the first LED string switches and the timing at which the number of serial stages of the second LED string switches are set so as to differ from each other. As a result of this, the timing at which the current value of the current I1 changes and the timing at which the current value of the current I2 changes differ therebetween. Consequently, the LED illuminator 10 is configured so that the state where the total harmonic distortion is lower is brought about by increasing/decreasing the total current I0 at small steps, which is the sum of the current I1, the current I2, etc.

Figure 2:
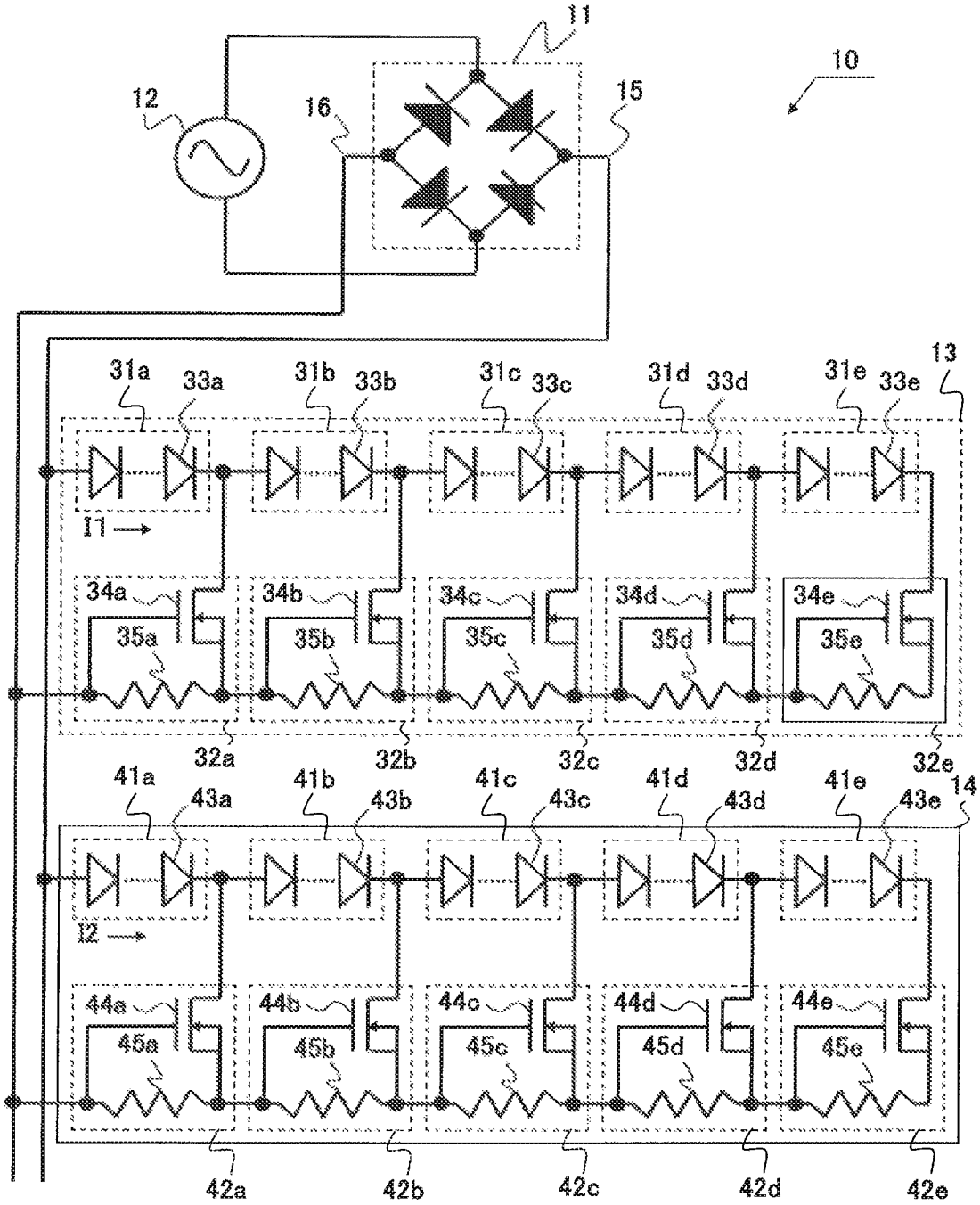
FIG. 2 is a circuit diagram of the LED illuminator 10 illustrated in FIG. 1.

FIG. 2 is a circuit diagram of the LED illuminator 10 illustrated in FIG. 1.

As illustrated in FIG. 2, the bridge rectifier circuit 11 consists of four diodes and includes an input terminal and an output terminal. To the input terminal of the bridge rectifier circuit 11, the commercial AC power source 12 is connected, and to the output terminal, the wire 15 for applying a full-wave rectified waveform and the wire 16, which is the ground wire, are connected.

In the first LED drive circuit 13, five partial LED strings 31*a*, 31*b*, 31*c*, 31*d*, and 31*e* are connected in series. In each of the partial LED strings 31*a*, 31*b*, 31*c*, 31*d*, and 31*e*, a plurality of LEDs 33*a*, a plurality of LEDs 33*b*, a plurality of LEDs 33*c*, a plurality of LEDs 33*d*, and a plurality LEDs 33*e* are connected in series, respectively. The LED string in which the partial LED strings 31*a*, 31*b*, 31*c*, 31*d*, and 31*e* are connected in series corresponds to the first LED string included in the first LED drive circuit 13.

In the first LED drive circuit 13, to the connection portion of the partial LED strings 31*a* and 32*b*, to that of the partial LED strings 31*b* and 31*c*, to that of the partial LED strings 31*c* and 31*d*, and to that of the partial LED strings of 31*d* and 31*e*, bypass circuits 32*a*, 32*b*, 32*c*, and 32*d* are connected, respectively, and to the cathode of the partial LED string 31*e*, a constant current circuit 32*e* is connected. The bypass circuits 32*a*, 32*b*, 32*c*, and 32*d* and the constant current circuit 32*e* include depletion-type FETs 34*a*, 34*b*, 34*c*, 34*d*, and 34*e*, respectively, and resistors 35*a*, 35*b*, 35*c*, 35*d*, and 35*e*, respectively. The bypass circuits 32*a*, 32*b*, 32*c*, and 32*d* and the constant current circuit 32*e* function as a switching circuit configured to switch the numbers of serial stages of LEDs included in the first LED string in accordance with the voltage of the full-wave rectified waveform.

In each of the bypass circuits 32*a*, 32*b*, 32*c*, and 32*d* and the constant current circuit 32*e*, the drain of each of the FETs 34*a*, 34*b*, 34*c*, 34*d*, and 34*e* is the current input terminal, respectively, and the left terminal of each of the resistors 35*a*, 35*b*, 35*c*, 35*d*, and 35*e* is the current output terminal, respectively. In each of the bypass circuits 32*a*, 32*b*, 32*c*, and 32*d*, the right terminal of each of the resistors 35*a*, 35*b*, 35*c*, and 35*d* is the other current input terminal, respectively, and to each of the other current input terminals, the current output terminal of each of the bypass circuits 32*b*, 32*c*, and 32*d* and the constant current circuit 32*e* is connected, respectively.

In the second LED drive circuit 14, five partial LED strings 41*a*, 41*b*, 41*c*, 41*d*, and 41*e* are connected in series. In each of the partial LED strings 41*a*, 41*b*, 41*c*, 41*d*, and 41*e*, a plurality of LEDs 43*a*, a plurality of LEDs 43*b*, a plurality of LEDs 43*c*, a plurality of LEDs 43*d*, and a plurality of LEDs 43*e* are connected in series, respectively. The LED string in which the partial LED strings 41*a*, 41*b*, 41*c*, 41*d*, and 41*e* are connected in series corresponds to the second LED string included in the second LED drive circuit 14.

In the second LED drive circuit 14, to the connection portion of the partial LED strings 41*a* and 41*b*, to that of the partial LED strings 41*b* and 41*c*, to that of the partial LED strings 41*c* and 41*d*, and to that of the partial LED strings of 41*d* and 41*e*, bypass circuits 42*a*, 42*b*, 42*c*, and 42*d* are connected, respectively, and to the cathode of the partial LED string 41*e*, a constant current circuit 42*e* is connected. The bypass circuits 42*a*, 42*b*, 42*c*, and 42*d* and the constant current circuit 42*e* include depletion-type FETs 44*a*, 44*b*, 44*c*, 44*d*, and 44*e*, respectively, and resistors 45*a*, 45*b*, 45*c*, 45*d*, and 45*e*, respectively. The bypass circuits 42*a*, 42*b*, 42*c*, and 42*d* and the constant current circuit 42*e* function as a switching circuit configured to switch the numbers of serial stages of LEDs included in the second LED string in accordance with the voltage of the full-wave rectified waveform.

In each of the bypass circuits 42*a*, 42*b*, 42*c*, and 42*d* and the constant current circuit 42*e*, the drain of each of the FETs 44*a*, 44*b*, 44*c*, 44*d*, and 44*e* is the current input terminal, respectively, and the left terminal of each of the resistors 45*a*, 45*b*, 45*c*, 45*d*, and 45*e* is the current output terminal, respectively. In each of the bypass circuits 42*a*, 42*b*, 42*c*, and 42*d*, the right terminal of each of the resistors 45*a*, 45*b*, 45*c*, and 45*d* is the other current input terminal, respectively, and to each of the other current input terminals, the current output terminal of each of the bypass circuits 42*b*, 42*c*, and 42*d* and the constant current circuit 42*e* is connected, respectively.

In the first LED drive circuit 13, the number of serial stages of LEDs 33*a*, that of serial stages of LEDs 33*b*, that of serial stages of LEDs 33*c*, that of serial stages of LEDs 33*d*, and that of serial stages of LEDs 33*e* in each of the partial LED strings 31*a*, 31*b*, 31*c*, 31*d*, and 31*e* are set to 20, 20, 20, 17, and 13, respectively. In the second LED drive circuit 14, the number of serial stages of LEDs 43*a*, that of serial stages of LEDs 43*b*, that of serial stages of LEDs 43*c*, that of serial stages of LEDs 43*d*, and that of serial stages of LEDs 43*e* in each of the partial LED strings 41*a*, 41*b*, 41*c*, 41*d*, and 41*e* are set to 10, 20, 20, 17, and 23, respectively. The numbers of serial stages are different between the partial LED string 31*a* and the partial LED string 41*a*, and the numbers of serial stages are different between the partial LED string 31*a* and the partial LED string 41*e*. Both the total number of serial stages of the first LED string and the total number of serial stages of the second LED string are 90 and equal.

The forward voltage of the LED is about 3 V and the total numbers of serial stages of the first and second LED strings are 90, and therefore, the voltage at which all the LEDs light up is about 270 V. That is, the first and second LED drive circuits 13 and 14 are designed so as to adapt to the commercial AC power source the effective value of which is 240 V (maximum voltage is about 336 V).

Figure 3A:
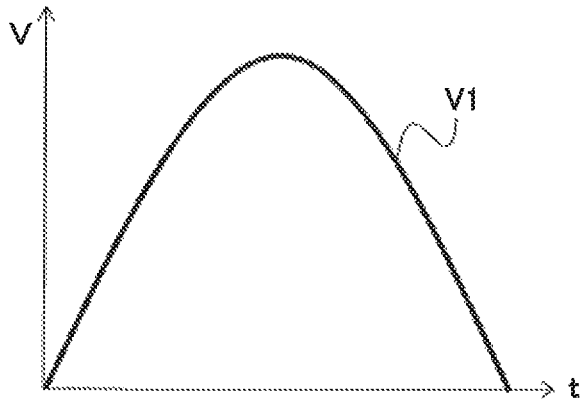
FIG. 3A is a waveform diagram illustrating a relationship between a full-wave rectified voltage waveform V1 corresponding to one period and a time t in the LED illuminator 10.
Figure 3B:
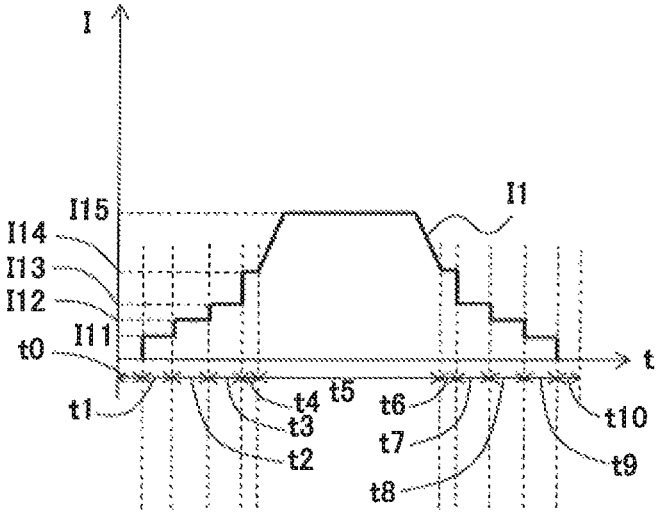
FIG. 3B is a waveform diagram illustrating a relationship between a current I1 that flows into a first LED drive circuit 13 and the time t.
Figure 3C:
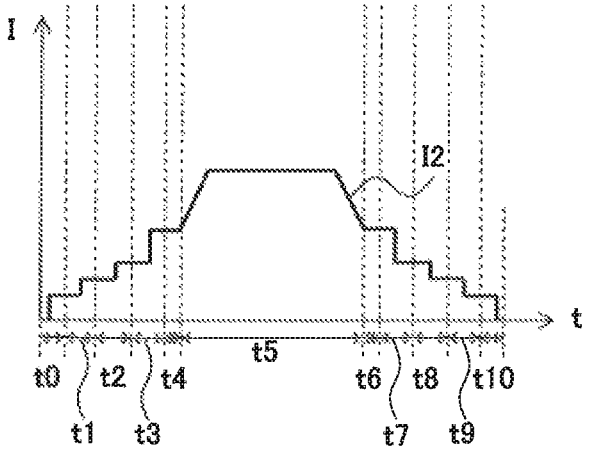
FIG. 3C is a waveform diagram illustrating a relationship between a current I2 that flows into a second LED drive circuit 14 and the time t.
Figure 3D:
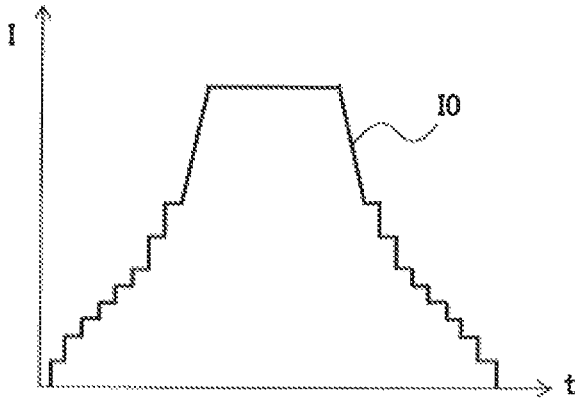
FIG. 3D is a waveform diagram illustrating a relationship between a total current I0 and the time t.

FIG. 3A is a waveform diagram illustrating a relationship between a full-wave rectified voltage waveform V1 corresponding to one period and a time t in the LED illuminator 10. FIG. 3B is a waveform diagram illustrating a relationship between the current I11 that flows into the first LED drive circuit 13 and the time t. FIG. 3C is a waveform diagram illustrating a relationship between the current I2 that flows into the second LED drive circuit 14 and the time t. FIG. 3D is a waveform diagram illustrating a relationship between the total current I0 and the time t. The scale of the time axis is the same in FIG. 3A to FIG. 3D.

By using FIG. 3A and FIG. 3B, the operation of the first LED drive circuit 13 is explained. A period of time t0 is a period of time during which the full-wave rectified voltage waveform V1 does not reach a threshold value (product of the forward voltage and the number of serial stages of the LEDs 33*a*, hereinafter, this also applies) of the partial LED string 31*a*. During the period of time to, the current I1 does not flow through the partial LED string 31*a*.

A period of time t1 is a period of time during which the full-wave rectified voltage waveform V1 exceeds the threshold value of the partial LED string 31*a* and is less than or equal to the sum value of the threshold value of the partial LED string 31*a* and a threshold value of the partial LED string 31*b*. During the period of time t1, the current I1 flows through the bypass circuit 32*a* from the partial LED string 31*a* and returns to the bridge rectifier circuit 11. At this time, the voltage drop of the resistor 35*a* is fed back to the FET 34*a*, and therefore, a constant current I11 flows through the bypass circuit 32*a*. The transitional situation where the current I1 changes from 0 (A) to the current I11 is ignored (hereinafter, this also applies).

A period of time t2 is a period of time during which the full-wave rectified voltage waveform V1 exceeds the sum value of the threshold value of the partial LED string 31*a* and the threshold value of the partial LED string 31*b* and is less than or equal to the sum value of the threshold value of the partial LED string 31*a*, the threshold value of the partial LED 31*b*, and a threshold value of the partial LED string 31*c*. During the period of time t2, a current flows from the partial LED string 31*b* to the bypass circuit 32*b*. Due to this current, the FET 34*a* cuts off because the source voltage increases, the current I1 flows between the source and the drain of the FET 34*b*, and the current value becomes that of a current I12.

When the current begins to flow through the partial LED strings 31*c*, 31*d*, and 31*e* as described above, the bypass circuits 32*b*, 32*c*, and 32*d* cut off in order, and the value of the current I1 during each of period of times t3, t4, and t5 becomes the value of each of currents I13, I14, and I15, respectively. During the period of time t5, the current I1 is set so as to change considerably from the current I14 to the current I15, and therefore, in FIG. 3B, the transitional state of the period of time t5 is also illustrated. During periods of time (period of time t6 to period of time t10) during which the full-wave rectified voltage waveform V1 decreases, the first LED drive circuit 13 follows the processes in the order opposite to that when the full-wave rectified voltage waveform V1 increases.

By using FIG. 3A and FIG. 3C, the operation of the second LED drive circuit 14 is explained. As illustrated in FIG. 3C, the first rise of the current I2 exists in the middle of the period of time t0 in FIG. 3B. In the first LED drive circuit 13, when the full-wave rectified voltage waveform V1 is 60 V (3 V*20 stages), the first rise of the current I1 appears (see FIG. 3B). On the other hand, in the second LED drive circuit 14, when the full-wave rectified voltage waveform V1 is 30 V (3 V*10 stages), the first rise of the current I2 appears. Similarly, the second to fourth rises of the current I2 appear in the middle of the period of times t1, t2, and t3, respectively. Both the fifth rises of the current I1 and the current I2 appear when the full-wave rectified voltage waveform V1 is 270 V (3 V*90 stages) (see FIG. 3B and FIG. 3C).

In the first LED drive circuit 13 and the second LED drive circuit 14, the FETs 34*a* to 34*e* and the FETs 44*a* to 44*e* are all the same. The resistor 35*a* and the resistor 45*a* are set to 54Ω, the resistor 35*b* and the resistor 45 are set to 32.4Ω, the resistor 35*c* and the resistor 45*c* are set to 21.6Ω, the resistor 35*d* and the resistor 45*d* are set to 10.8Ω, and the resistor 35*e* and the resistor 45*e* are set to 5.4Ω. As a result of this, for example, the current value at the first flat part (current I11) of the current I1 becomes equal to the current value at the first flat part of the current I2.

The current I0 illustrated in FIG. 3D is the sum of the current I1 in FIG. 3B and the current I2 in FIG. 3C, and increases/decrease at small steps except for the period of time t5. By increasing/decreasing the current I0 at small steps as described above, the total harmonic distortion is reduced. During the period of time t5, the current I0, which is a comparatively large current, is caused to flow through the entire first and second LED strings so as to improve luminance.

In the LED illuminator 10 illustrated in FIG. 2, it is possible to connect more LED drive circuits to the bridge rectifier circuit 11 in parallel to the first and second LED drive circuits 13 and 14, in addition to the first and second LED drive circuits 13 and 14. By making the switching timing of the number of serial stages of the added LED drive circuit differ from the switching timing of the number of serial stages of the first and second LED drive circuits 13 and 14, it is possible, to cause the current I0 to increase/decrease at smaller steps.

In the LED illuminator 10, both the numbers of partial LED strings included in the first and second LED drive circuits 13 and 14 are set to five, but the number is not limited to this and it may also be possible to set another number. Further, the number of LEDs included in each partial LED string and the total number of LEDs included in all the LED strings are also not limited to the numbers described above and it is possible to appropriately select the numbers in accordance with the effective value or the like of the commercial AC power source that is made use of. Furthermore, the number of LEDs included in one partial LED string may be one.

Figure 4A:
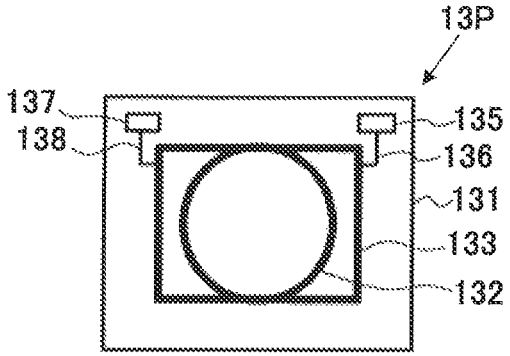
FIG. 4A is a plan view of the first LED drive circuit 13.
Figure 4B:
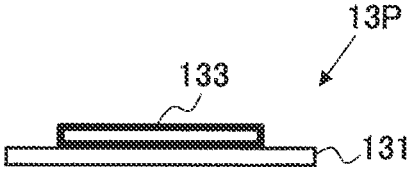
FIG. 4B is a front view of the first LED drive circuit 13.

FIG. 4A is a plan view of the first LED drive circuit 13 and FIG. 4B is a front view of the first LED drive circuit 13. In FIG. 4A and FIG. 4B, the case is illustrated where the first LED drive circuit 13 is configured as a first module 13P.

As illustrated in FIG. 4A and FIG. 4B, the first module 13P includes areas demarcated by dam materials 132 and 133 on a packaging substrate 131. In the circular area surrounded by the dam material 132, the LEDs 33*a* to 33*e* (see FIG. 2) are packaged and connected in series with one another by wires. In the two areas demarcated by the dam material 132 and the dam material 133, the FETs 34*a* to 34*e* and the resistors 35*a* to 35*e* are packaged. The LEDs 33*a* to 33*e*, the FETs 34*a* to 34*e*, and the resistors 35*a* to 35*e* are covered with a resin containing phosphors. On the surface of the packaging substrate, a terminal 135 to which the full-wave rectified waveform is input and a terminal 137 to which the ground wire is connected are provided and wires 136 and 138 that connect to the terminals 135 and 137, respectively, extend to the inside of the dam materials 132 and 133.

Figure 5:
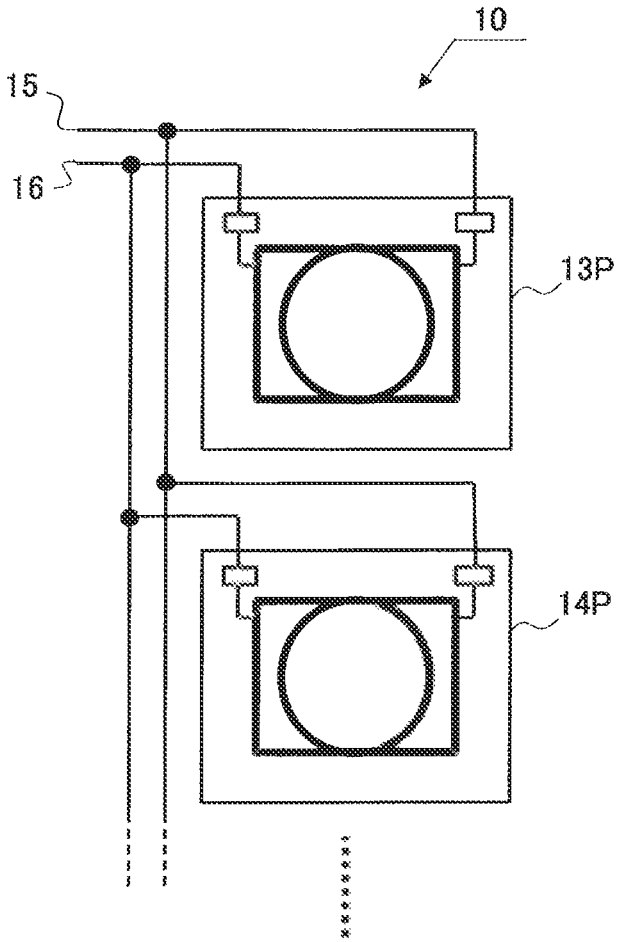
FIG. 5 is a diagram illustrating a connection situation of a first module 13P and a second module 14P.

FIG. 5 is a diagram illustrating a connection situation of the first module 13P and a second module 14P obtained by configuring the second LED drive circuit 14 as a module.

As illustrated in FIG. 5, the first module 13P and the second module 14P are connected in parallel as a single module, respectively. The wire 15 is a wire through which the full-wave rectified waveform is applied and the wire 16 is a ground wire. In the second module 14P obtained by configuring the second LED drive circuit 14 as a module, the number of LEDs included in each partial LED string is different, and the way the LEDs 43*a* to 43*e* packaged in the circular area surrounded by the dam material are wire-bonded is different. The other configurations of the second module 14P are the same as those of the first module 13P described previously. It may also be possible to configure the first LED drive circuit 13 and the second LED drive circuit 14 as one module.

As illustrated in FIG. 1 and FIG. 2, the LED illuminator 10 has the two LED drive circuits (the first LED drive circuit 13 and the second LED drive circuit 14) connected in parallel. However, the number of LED drive circuits connected in parallel in the LED illuminator is not limited to two. For example, it may also be possible to connect the two first LED drive circuits 13 and the two second LED drive circuits 14 in parallel. Further, it may also be possible to connect in parallel third LED drive circuits of which the switching timing of the numbers of serial stages of the LED strings is different from that of the first and second LED drive circuits 13 and 14.

The number of partial LED strings included in the first LED drive circuit 13 is not limited to five. For example, it may also be possible to have only two partial LED strings. In this case, it may be possible to configure the first LED drive circuit 13 only by the partial LED strings 31*a* and 31*e*, the bypass circuit 32*a*, and the constant current circuit 32*e*. This is also true with the second LED drive circuit 14.

In the LED illuminator 10, the combination of the numbers of serial stages of the partial LED strings 31*a*, 31*b*, 31*c*, 31*d*, and 31*e* obtained by dividing the first LED string included in the first LED drive circuit 13 is set to 20 stages, 20 stages, 20 stages, 17 stages, and 13 stages. Further, the combination of the numbers of serial stages of the partial LED strings 41*a*, 41*b*, 41*c*, 41*d*, and 41*e* obtained by dividing the second LED string included in the second LED drive circuit 14 is set to 10 stages, 20 stages, 20 stages, 17 stages, and 23 stages. In this manner, in the LED illuminator 10, the combination of the numbers of serial stages of the partial LED string in the first LED drive circuit 13 is set so as to differ from that in the second LED drive circuit 14.

However, as illustrated in the first LED drive circuit 13 and the second LED drive circuit 14, it is not necessary to considerably change the combination of serial stages of the partial LED string. For example, it may also be possible to set so that only the number of serial stages (20 stages) of the partial LED string 31*a* that lights up during the period of time during which the voltage is the lowest in the first LED drive circuit 13 differs from the number of serial stages (10 stages) of the partial LED string 41*a* that lights up during the period of time during which the voltage is the lowest in the second LED drive circuit 14.

The resistor 35*a* or the like illustrated in FIG. 2 is a single element, but for example, in the case where a gate protection resistor is inserted additionally between the left end of the resistor 35*a* and the FET 34*a*, it may also be possible to integrate the gate protection resistor and the resistor 35*a* into one network resistor. The above-describe change can also be applied to all the other bypass circuits and constant current circuits.

Figure 6:
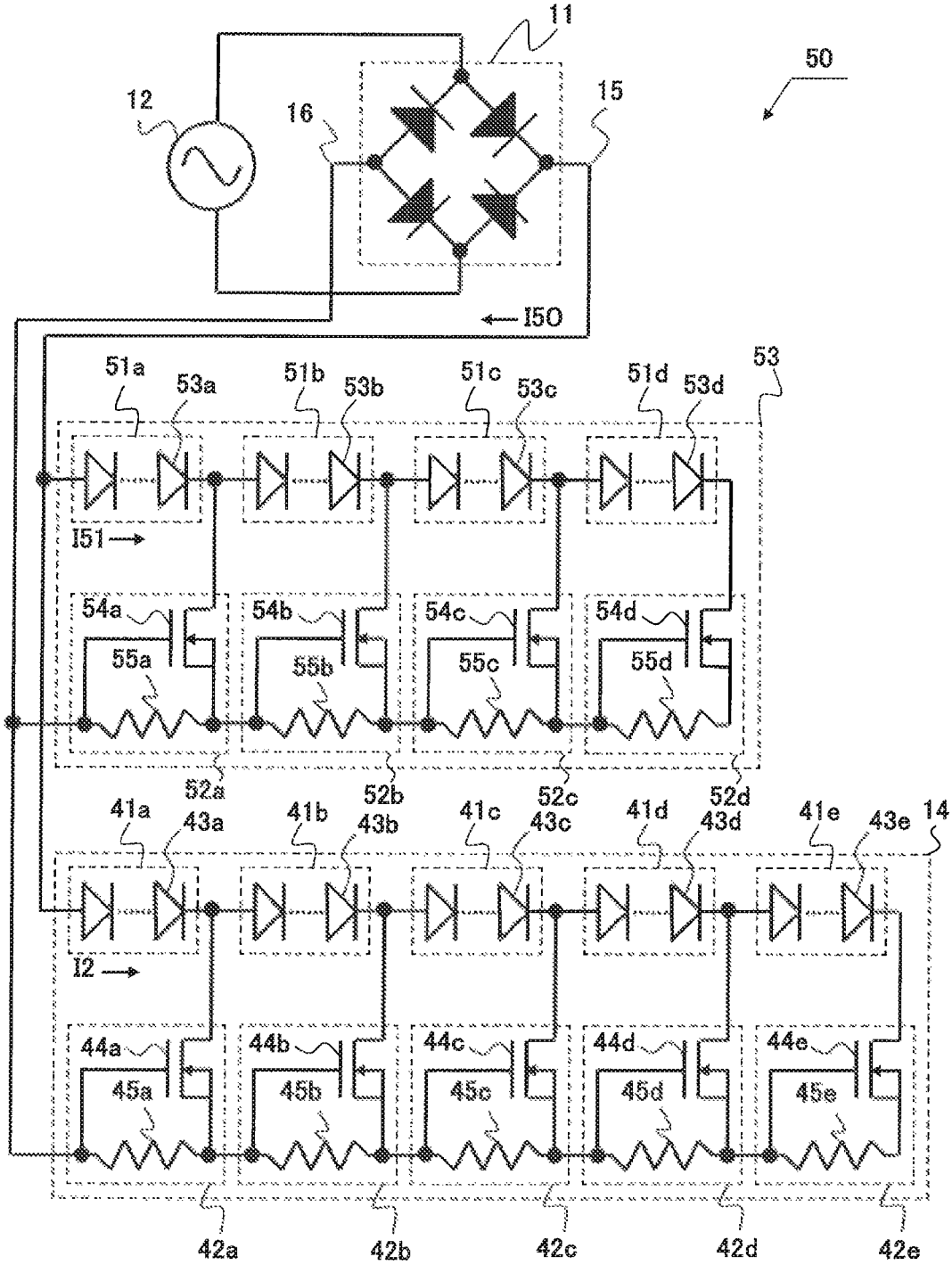
FIG. 6 is a circuit diagram of another LED illuminator 50.

FIG. 6 is a circuit diagram of another LED illuminator 50.

The difference between the LED illuminator 50 illustrated in FIG. 6 and the LED illuminator 10 illustrated in FIG. 2 lies only in that a first LED drive circuit 53 included in the LED illuminator 50 differs from the first LED drive circuit 13 included in the LED illuminator 10. The other configurations are the same as those of the LED illuminator 10, and therefore, explanation thereof is omitted.

In the first LED drive circuit 53, four partial LED strings 51*a*, 51*b*, 51*c*, and 51*d* are connected in series. In each of the partial LED strings 51*a*, 51*b*, 51*c*, and 51*d*, a plurality of LEDs 53*a*, a plurality of LEDs 53*b*, a plurality of LEDs 53*c*, and a plurality of LEDs 53*d* are connected in series, respectively. The LED string in which the partial LED strings 51*a*, 51*b*, 51*c*, and 51*d* are connected in series corresponds to the first LED sting included in the first LED drive circuit 53.

In the first LED drive circuit 53, to the connection portion of the partial LED strings 51*a* and 51*b*, to that of the partial LED strings 51*b* and 51*c*, and to that of the partial LED strings 51*c* and 51*b*, bypass circuits 52*a*, 52*b*, and 52*c* are connected, respectively, and to the cathode of the partial LED string 51*d*, a constant current circuit 52*d* is connected. The bypass circuits 52*a*, 52*b*, and 52*c* and the constant current circuit 52*d* include depletion-type FETs 54*a*, 54*b*, 54*c*, and 54*d*, respectively, and resistors 55*a*, 55*b*, 55*c*, and 55*d*, respectively. The bypass circuits 52*a*, 52*b*, and 52*c* and the constant current circuit 52*d* function as a switching circuit configured to switch the numbers of serial stages of LEDs included in the first LED string in accordance with the voltage of the full-wave rectified waveform.

In each of the bypass circuits 52*a*, 52*b*, and 52*c* and the constant current circuit 52*d*, the drain of each of the FETs 54*a*, 54*b*, 54*c*, and 54*d* is the current input terminal, respectively, and the left terminal of each of the resistors 55*a*, 55*b*, 55*c*, and 55*d* is the current output terminal, respectively. In each of the bypass circuits 52*a*, 52*b*, and 52*c*, the right terminal of each of the resistors 55*a*, 55*b*, and 55*c* is the other current input terminal, respectively, and to each of the other current input terminals, the current output terminal of each of the bypass circuits 52*b* and 52*c* and the constant current circuit 52*d* is connected, respectively.

In the first LED drive circuit 53, the number of serial stages of LEDs 53*a*, that of serial stages of LEDs 53*b*, that of serial stages of LEDs 53*c*, and that of serial stages of LEDs 53*d* in each of the partial LED strings 51*a*, 51*b*, 51*c*, and 51*d* are set to 20, 20, 20, and 30, respectively. In the second LED drive circuit 14, the number of serial stages of LEDs 43*a*, that of serial stages of LEDs 43*b*, that of serial stages of LEDs 43*c*, that of serial stages of LEDs 43*d*, and that of serial stages of LEDs 43*e* in each of the partial LED strings 41*a*, 41*b*, 41*c*, 41*d*, and 41*e* are set to 10, 20, 20, 17, and 23, respectively. Both the total number of serial stages of the first LED string and the total number of serial stages of the second LED string are 90 and equal.

The forward voltage of the LED is about 3 V and both the total numbers of the first and second LED strings are 90, and therefore, the voltage at which all the LEDs light up is about 270 V. That is, the first LED drive circuit 53 and the second LED drive circuit 14 are designed so as to adapt to the commercial AC power source the effective value of which is 240 V (maximum voltage is about 336 V).

Figure 7A:
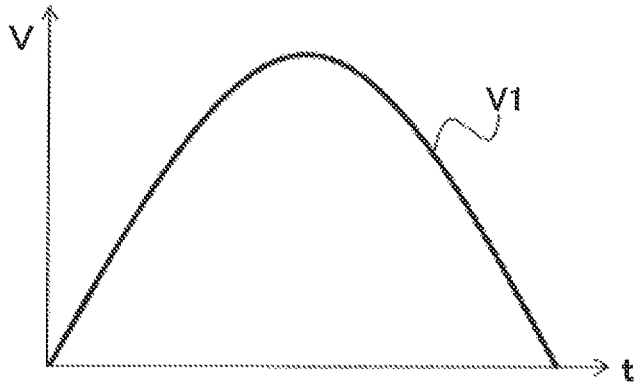
FIG. 7A is a waveform diagram illustrating a relationship between the full-wave rectified voltage waveform V1 corresponding to one period and the time t in the LED illuminator 50.
Figure 7B:
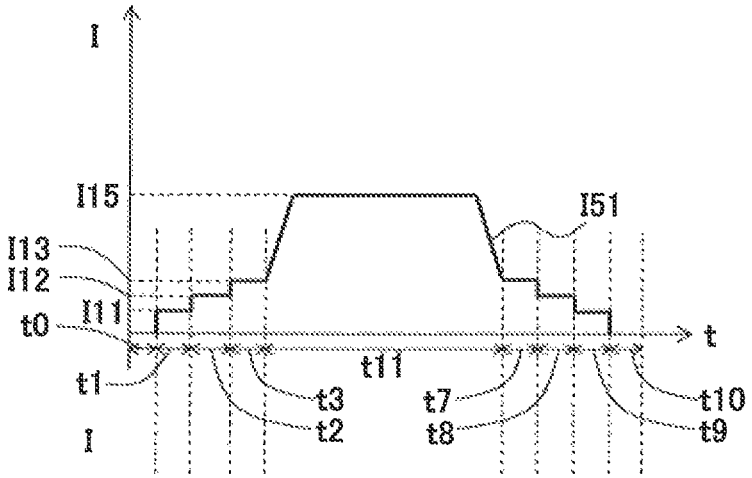
FIG. 7B is a waveform diagram illustrating a relationship between a current I51 that flows into a first LED drive circuit 53 and the time t.
Figure 7C:
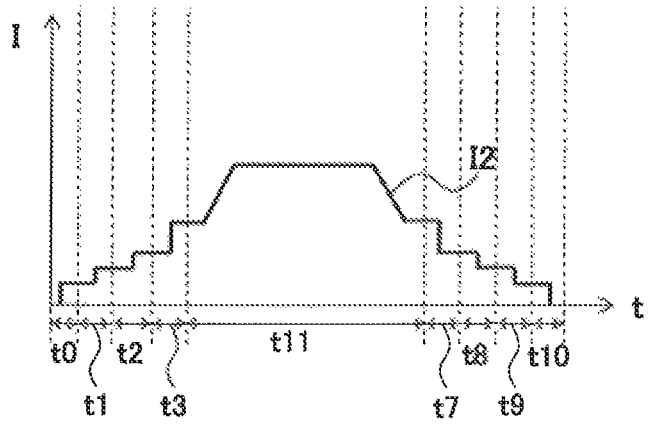
FIG. 7C is a waveform diagram illustrating a relationship between the current I2 that flows into the second LED drive circuit 14 and the time t.
Figure 7D:
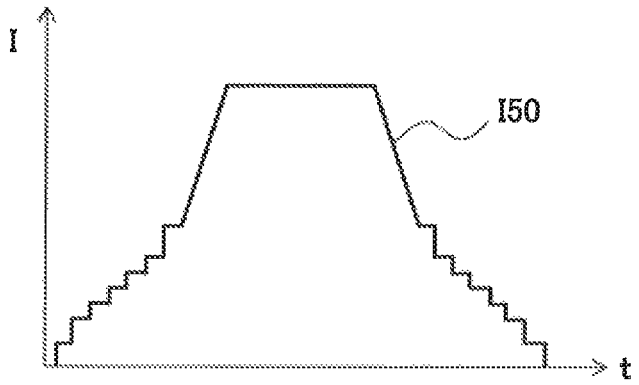
FIG. 7D is a waveform diagram illustrating a relationship between a total current I50 and the time t.

FIG. 7A is a waveform diagram illustrating a relationship between the full-wave rectified voltage waveform V1 corresponding to one period and the time t in the LED illuminator 50. FIG. 7B is a waveform diagram illustrating a relationship between a current I51 that flows into the first LED drive circuit 53 and the time t. FIG. 7C is a waveform diagram illustrating a relationship between the current I2 that flows into the second LED drive circuit 14 and the time t. FIG. 7D is a waveform diagram illustrating a relationship between a total current I50 and the time t. The scale of the time axis is the same in FIG. 7A to FIG. 7D. FIG. 7A illustrates the same waveform as that in FIG. 3A and FIG. 7C illustrates the same waveform as that in FIG. 3C.

As illustrated in FIG. 7B, for the full-wave rectified voltage waveform V1 (see FIG. 7A), the current I51 that flows through the first LED drive circuit 53 has five stages (including I51=0 (A)). Here, a period of time (t11) during which the current I51 has the current value I15 is equal to the period of time, which is the sum of the period of time t4, the period of time t5, and the period of time t6 in FIG. 3B. The resistance of the resistor 55*d* is set to the same resistance of the resistor 35*e* in FIG. 2 so that the maximum current of the LED illuminator 10 is equal to that of the LED illuminator 50. The current I50 that flows through the LED illuminator 50 illustrated in FIG. 7D is the sum of the current I51 illustrated in FIG. 7B and the current I2 illustrated in FIG. 7C.

In the LED illuminator 50 also, the timing at which the current I51 that flows through the first LED drive circuit 53 rises and the timing at which the current I2 that flows through the second LED drive circuit 14 rises are set so to differ from each other. As a result of this, the current I50 illustrated in FIG. 7D is the sum of the current I51 in FIG. 7B and the current I2 in FIG. 7C, and the current I50 increases/decreases at small steps except for the period of time t11. By increasing/decreasing the current I50 at small steps in this manner, the total harmonic distortion is reduced. During the period of time t11, the current I50, which is a comparatively large current, is caused to flow through the entire first and second LED strings so as to improve luminance.

In the LED illuminator 10 described previously, the number of partial LED strings included in the first LED drive circuit 13 and the number of partial LED strings included in the second LED drive circuit 14 are set so as to be equal to each other (both, five). Further, in the LED illuminator 10, the timing at which the numbers of partial LED strings included in the first LED drive circuit 13 are switched and the timing at which the numbers of partial LED strings included in the second LED drive circuit 14 are switched are set so as to differ from each other. As a result of this, it is made possible to suppress the occurrence of noise by changing the total current (I0) flowing through the LED illuminator 10 at small steps. However, it is also possible to suppress the occurrence of noise by making the number of partial LED strings included in the first LED drive circuit 53 differ from the number of partial LED strings included in the second LED drive circuit 14 to change the total current (I50) at small steps as in an LED illuminator 50.

Figure 8:
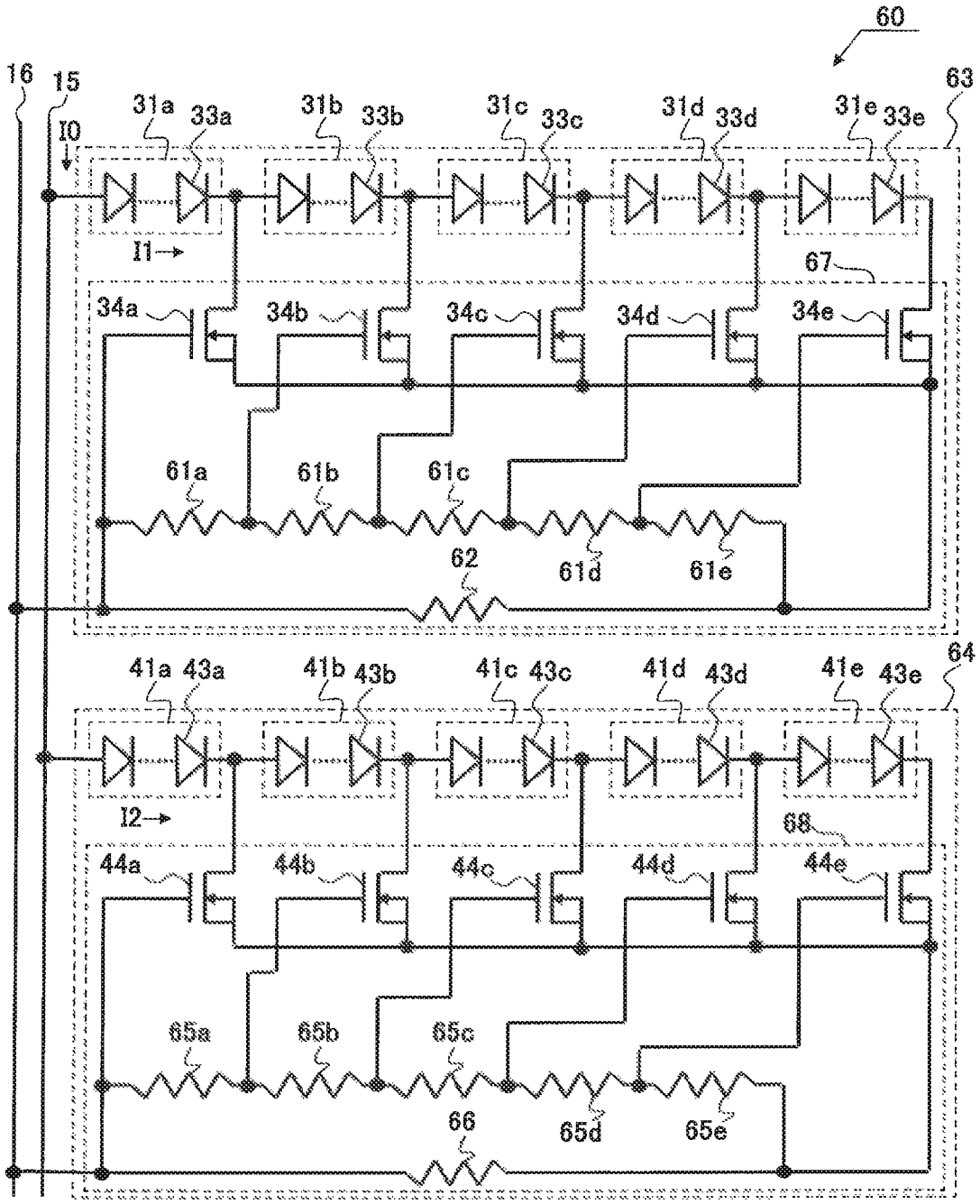
FIG. 8 is a circuit diagram of still another LED illuminator 60.

FIG. 8 is circuit diagram of the LED illuminator 60, which is still another LED illuminator.

In the FIG. 8, the commercial AC power source 12 (see FIG. 1) and the bridge rectifier circuit 11 (see FIG. 1) included in the LED illuminator 60 are the same as those included in the LED illuminator 10 illustrated in FIG. 1, and therefore, they are not illustrated. As illustrated in FIG. 8, the LED illuminator 60 includes a first LED drive circuit 63 and a second LED drive circuit 64. In the LED illuminator 60, the same numerals are attached to the same configurations as those of the LED illuminator 10 illustrated in FIG. 2, and explanation thereof is omitted.

The first LED drive circuit 13 included in the LED illuminator 10 illustrated in FIG. 2 has the configuration in which the circuit blocks including the partial LED string 31*a*, the bypass circuit 32*a*, etc., are connected in the form of a ladder. Each of the resistors 35*a* to 35*e* included in the first LED drive circuit 13 is a current detection resistor for feedback-controlling (setting the current constant) and cutting off each of the FETs 34*a* to 34*e*, respectively (this also applies to the second LED drive circuit 14). In contrast to this, in each of the first LED drive circuit 63 and the second LED drive circuit 64 of the LED illuminator 60, only one current detection resistor is provided and the FETs 34*a* to 34*e* are controlled only by divided voltages thereof.

As illustrated in FIG. 8, in the first LED drive circuit 63, the sources of the FETs 34*a*, 34*b*, 34*c*, 34*d*, and 34*e* are connected and are connected to the right terminal of an only current detection resistor 62. In the first LED drive circuit 63, the FETs 34*a* to 34*e* are controlled by the terminal-to-terminal voltage of the current detection resistor 62 or the divided voltages thereof. First, the resistance of the current detection resistor 62 is set to the same value (54Ω) as that of the resistor 35*a* (see FIG. 2). Next, if the ratio of resistance between resistors 61*a*, 61*b*, 61*c*, 61*d*, and 61*e* is set equal to that between the resistors 35*a*, 35*b*, 35*c*, 35*d*, and 35*e* (see FIG. 2), the first LED drive circuit 63 and the first LED drive circuit 13 perform substantially the same operation. Here, it is assumed that each of the resistors 61*a* to 61*e* has a sufficiently high resistance value. As indicated by a dot line 67, the FETs 34*a*, 34*b*, 34*c*, 34*d*, and 34*e*, the resistors 61*a*, 61*b*, 61*c*, 61*d*, and 61*e*, and the current detection resistor 62 function as a switching circuit configured to switch the numbers of serial stages of LEDs included in the first LED string in accordance with the voltage of the full-wave rectified waveform.

As illustrated in FIG. 8, in the second LED drive circuit 64, the sources of the FETs 44*a*, 44*b*, 44*c*, 44*d*, and 44*e* are connected and are connected to the right terminal of an only current detection resistor 66. In the second LED drive circuit 64, the FETs 44*a* to 44*e* are controlled by the terminal-to-terminal voltage of the current detection resistor 66 or the divided voltages thereof. In the second LED drive circuit 64 also, first, the resistance of the current detection resistor 66 is set to the same value (54Ω) as that of the resistor 45*a* (see FIG. 2). Next, if the ratio of resistance between resistors 65*a*, 65*b*, 65*c*, 65*e*, and 65*e* is set equal to that between the resistors 45*a*, 45*b*, 45*c*, 45*d*, and 45*e* (see FIG. 2), the second LED drive circuit 64 and the second LED drive circuit 14 perform substantially the same operation. Here, it is assumed that each of the resistors 65*a* to 65*e* has a sufficiently high resistance value. As indicated by a dot line 68, the FETs 44*a*, 44*b*, 44*c*, 44*d*, and 44*e*, the resistors 65*a*, 65*b*, 65*c*, 65*d*, and 65*e*, and the current detection resistor 66 function as a switching circuit configured to switch the numbers of serial stages of LEDs included in the second LED string in accordance with the voltage of the full-wave rectified waveform.

In the LED illuminator 60, the transitional state where the first LED drive circuit 63 makes a transition from one constant current state into another constant current state is improved, and therefore, the luminance is improved more than in the LED illuminator 10 illustrated in FIG. 2 (this is also true with the second LED drive circuit 64).

In the LED illuminator 60, it is possible to increase the resistances of and downsize the resistors 61*a* to 61*e*. Further, the resistors 61*a* to 61*e* are required only to be capable of stably reproducing the mutual ratio, and therefore, there is such an advantage that it is easy to configure as a network resistor by combining the resistors 61*a* to 61*e* with the current detection resistor 62 the resistance of which is comparatively low, and therefore, the permitted power of which needs to be increased (this is also true with the resistors 65*a* to 65*e* of the second LED drive circuit 64). Here, in the first LED drive circuit 13 included in the LED illuminator 10 illustrated in FIG. 2, a gain G10 of the FET 34*e* during the transitional period from the period of time t4 to the period of time t5 is considered to be drain resistance Rd10/source resistance Rs10 (R35*a*+R35*b*+R35*c*+R35*d*+R35*e*) ("R35*a*" represents the resistance value of the resistor 35*a*. This also applied to the other resistors). Similarly, in the first LED drive circuit 63 included in the LED illuminator 60 illustrated in FIG. 8, a gain G60 of the FET 34*e* during the transitional period from the period of time t4 to the period of time t5 is considered to be drain resistance Rd60/source resistance Rs60 (R62). The value of Rd10 and that of Rd60 are substantially the same and Rs10>Rs60, and therefore, G60>G10 holds. That is, in the LED illuminator 60, the gain G60 of the FET 34*e* is larger, and therefore, the transitional response characteristics improve more than those in the LED illuminator 10.

Figure 9:
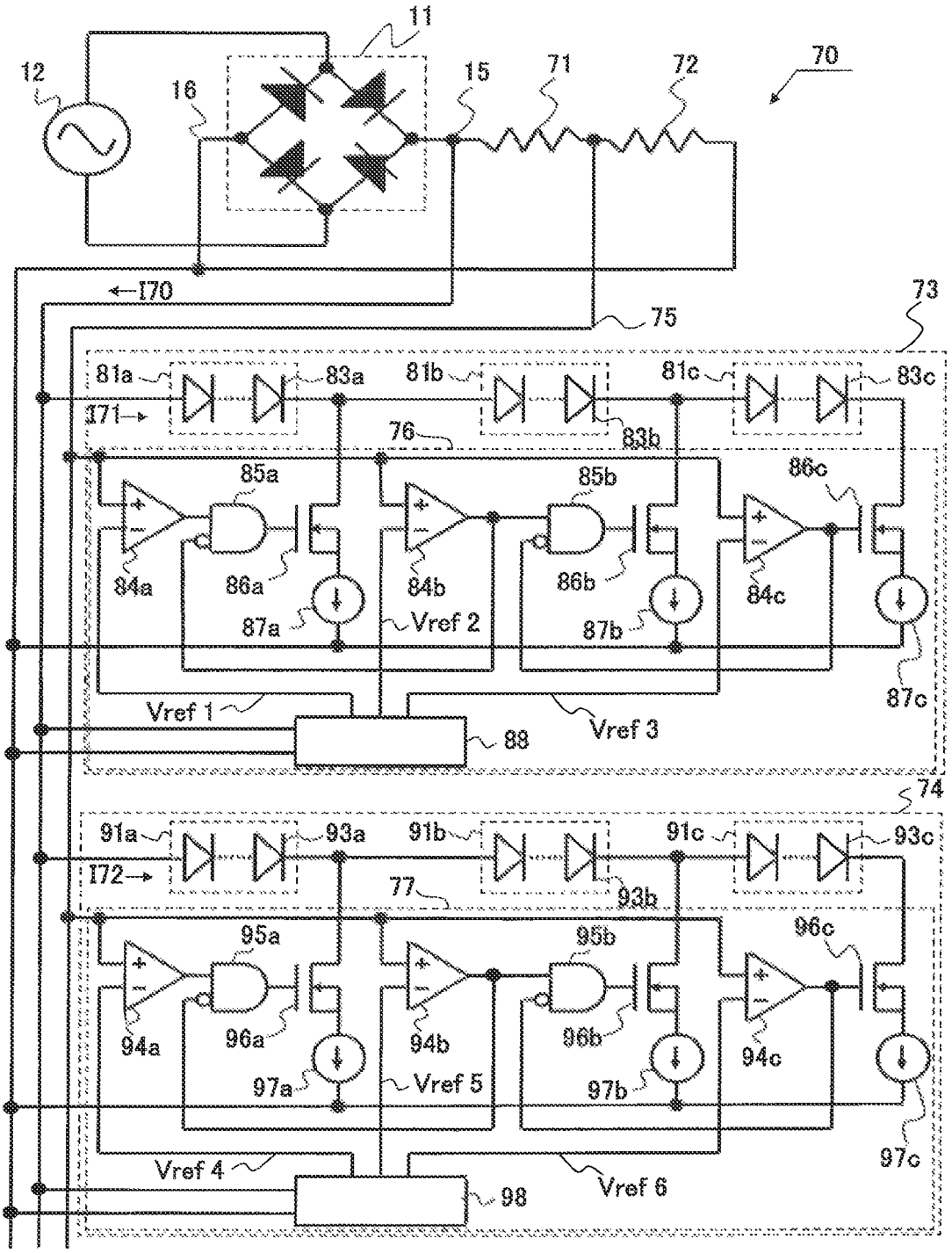
FIG. 9 is a circuit diagram of still another LED illuminator 70.

FIG. 9 is a circuit diagram of an LED illuminator 70, which is still another LED illuminator.

In the LED illuminators 10, 50, and 60 described previously, the numbers of serial stages of the first or second LED string are switched by detecting the current that flows through the first or second LED string. However, the switching of the numbers of serial stages of the first or second LED string is not limited to the method of detecting a current, and it is possible to employ a method of detecting a voltage. The LED illuminator 70 illustrated in FIG. 9 includes first and second LED drive circuits 73 and 74 that switch the numbers of serial stages of the first and second LED strings by detecting a voltage of a full-wave rectified waveform.

In FIG. 9, the commercial AC power source 12 and the bridge rectifier circuit 11 are common to those in FIG. 2, however, a wire 75 is added, which transmits a signal obtained by reducing the voltage of a full-wave rectified waveform by resistors 71 and 72 in order to control the number of serial stages at a low voltage. In the LED illuminator 70, the same numerals are attached to the same configurations as those of the LED illuminator 10 illustrated in FIG. 2 and explanation thereof is omitted.

As illustrated in FIG. 9, in the first LED drive circuit 73, three partial LED strings 81*a*, 81*b*, and 81*c* are connected in series. In each of the partial LED strings 81*a*, 81*b*, and 81*c*, a plurality of LEDs 83*a*, a plurality of LEDs 83*b*, and a plurality of LEDs 83*c* are connected in series, respectively. The LED string in which the partial LED strings 81*a*, 81*b*, and 81*c* are connected in series corresponds to the first LED string included in the first LED drive circuit 73.

In the first LED drive circuit 73, to the connection portion of the partial LED strings 81*a* and 81*b*, and to that of the partial LED strings 81*b* and 81*c*, a bypass circuit is connected, respectively, and to the cathode of the partial LED string 81*c*, a constant current circuit is connected. The bypass circuit that is connected to the connection portion of the partial LED strings 81*a* and 81*b* includes a comparator 84*a*, an AND element 85*a*, an enhancement type FET 86*a*, and a current limiting circuit 87*a*. The bypass circuit that is connected to the connection portion of the partial LED strings 81*b* and 81*c* includes a comparator 84*b*, an AND element 85*b*, an enhancement type FET 86*b*, and a current limiting circuit 87*b*. The constant current circuit includes a comparator 84*c*, an enhancement type FET 86*c*, and a current limiting circuit 87*c*. To each plus input terminal of the comparators 84*a* to 84*c*, the wire 75 is connected and to the minus input terminals, reference voltages Vref1, Vref2, and Vref3 are input respectively, which are output from a reference voltage generation circuit 88. As illustrated by a dot line 76, the comparators 84*a* to 84*c*, the AND elements 85*a* and 85*b*, the FETs 86*a* to 86*c*, the current limiting circuits 87*a* to 87*c*, and the reference voltage generation circuit 88 function as a switching circuit configured to switch the numbers of serial stages of LEDs included in the first LED string in accordance with the voltage of the full-wave rectified waveform.

As illustrated in FIG. 9, in the second LED drive circuit 74, three partial LED strings 91*a*, 91*b*, and 91*c* are connected in series. In each of the partial LED strings 91*a*, 91*b*, and 91*c*, a plurality of LEDs 93*a*, a plurality of LEDs 93*b*, and a plurality of LEDs 93*c* are connected in series, respectively. The LED string in which the partial LED strings 91*a*, 91*b*, and 91*c* are connected in series corresponds to the second LED string included in the second LED drive circuit 74.

In the second LED drive circuit 74, to the connection portion of the partial LED strings 91*a* and 91*b*, and to that of the partial LED strings 91*b* and 91*c*, a bypass circuit is connected, respectively, and to the cathode of the partial LED string 91*c*, a constant current circuit is connected. The bypass circuit that is connected to the connection portion of the partial LED strings 91*a* and 91*b* includes a comparator 94*a*, an AND element 95*a*, an enhancement type FET 96*a*, and a current limiting circuit 97*a*. The bypass circuit that is connected to the connection portion of the partial LED strings 91*b* and 91*c* includes a comparator 94*b*, an AND element 95*b*, an enhancement type FET 96*b*, and a current limiting circuit 97*b*. The constant current circuit includes a comparator 94*c*, an enhancement type FET 96*c*, and a current limiting circuit 97*c*. To each plus input terminal of the comparators 94*a* to 94*c*, the wire 75 is connected and to the minus input terminals, reference voltages Vref4, Vref5, and Vref6 are input, respectively, which are output from a reference voltage generation circuit 98. As illustrated by a dot line 77, the comparators 94*a* to 94*c*, the AND elements 95*a* and 95*b*, the FETs 96*a* to 96*c*, the current limiting circuits 97*a* to 97*c*, and the reference voltage generation circuit 98 function as a switching circuit configured to switch the numbers of serial stages of LEDs included in the second LED string in accordance with the voltage of the full-wave rectified waveform.

The maximum number of serial stages of the first and second LED strings included in the first and second LED drive circuits 73 and 74 is 90 as in the first and second LED drive circuits 13 and 14 illustrated in FIG. 2. The number of serial stages of the partial LED strings 81*a* to 81*c* and the number of serial stages of the partial LED strings 91*a* to 91*c* are determined based on the reference voltages Vref1 to Vref3 and the reference voltages Vref4 to Vref6, respectively, as will be described later. For example, it may also be possible to set all the numbers of stages to the same (30 stages). The upper limit current of the current limiting circuit 87*a* and that of the current limiting circuit 97*a* are set equal, the upper limit current of the current limiting circuit 87*b* and that of the current limiting circuit 97*b* are also set equal, and the upper limit current of the current limiting circuit 87*c* and that of the current limiting circuit 97*c* are also set equal. The upper limit current of the current limiting circuits 87*a* and 97*a* is set to the smallest value, the upper limit current of the current limiting circuits 87*b* and 97*b* is set to an intermediate value, and the upper limit current of the current limiting circuits 87*c* and 97*c* is set to the largest value.

The reference voltages Vref1 to Vref6 are set so as to have a relationship below.

Vref1<Vref4<Vref2<Vref5<Vref3<Vref6

Figure 10A:
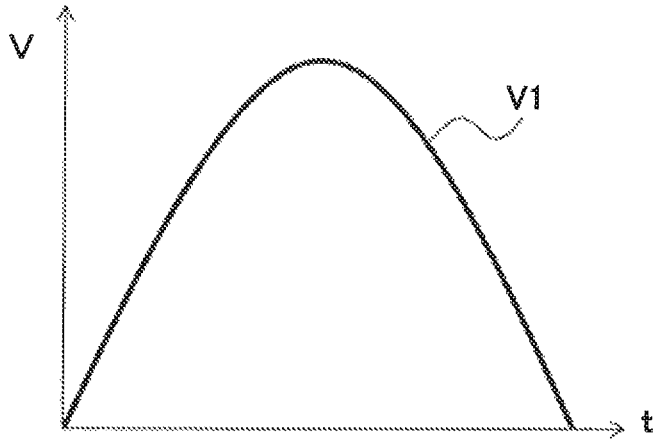
FIG. 10A is a waveform diagram illustrating a relationship between the full-wave rectified voltage waveform V1 corresponding to one period and the time t in the LED illuminator 70.
Figure 10B:
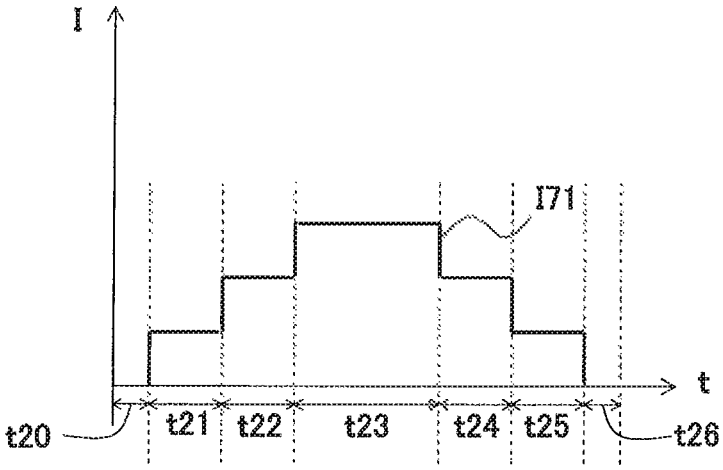
FIG. 10B is a waveform diagram illustrating a relationship between a current I71 that flows into a first LED drive circuit 73 and the time t.
Figure 10C:
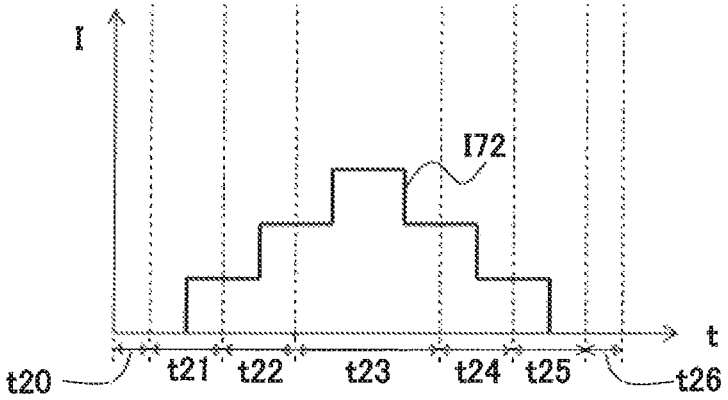
FIG. 10C is a waveform diagram illustrating a relationship between a current I72 that flows into a second LED drive circuit 74 and the time t.
Figure 10D:
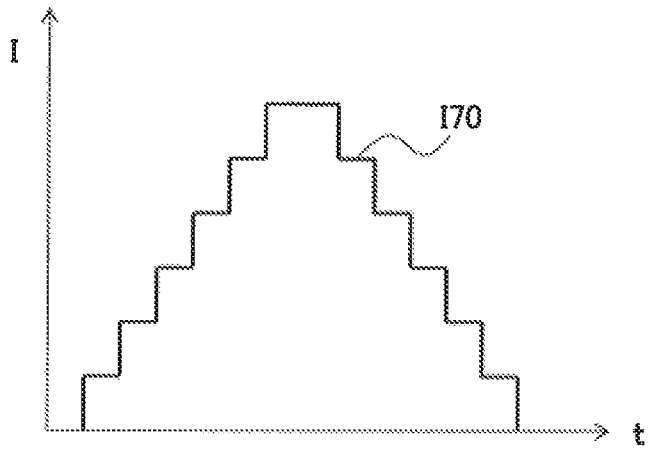
FIG. 10D is a waveform diagram illustrating a relationship between a total current I70 and the time t.
Figure 11:
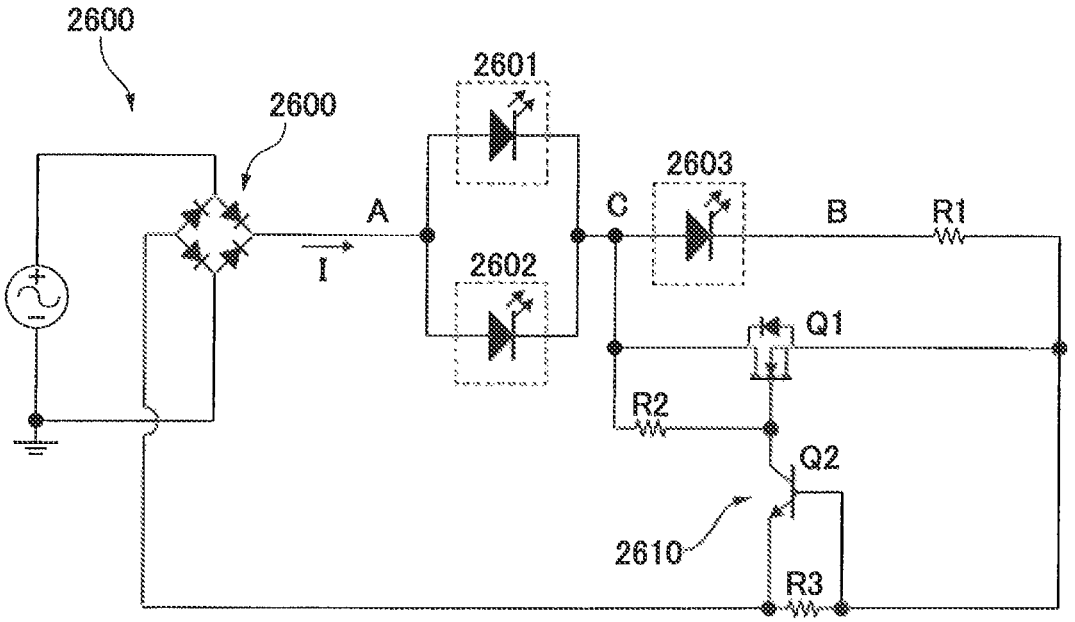
FIG. 11 is a circuit diagram of a light source circuit 2600 described in Patent Document 1.
Figure 12A:
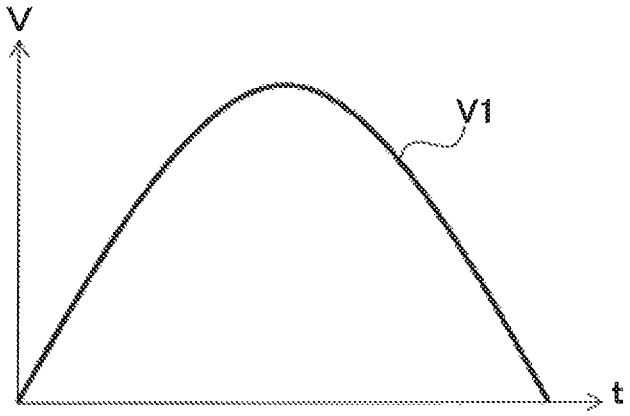
FIG. 12A is a waveform diagram illustrating a full-wave rectified voltage waveform corresponding to one period in the light source circuit 2600 illustrated in FIG. 11.
Figure 12B:
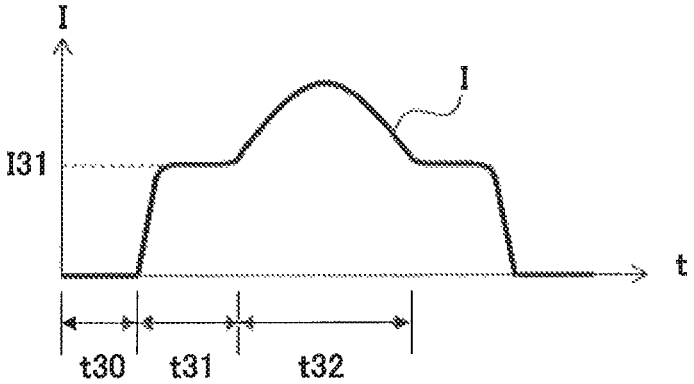
FIG. 12B is a waveform diagram illustrating a circuit current of the light source circuit 2600 illustrated in FIG. 11.

FIG. 10A is a waveform diagram illustrating a relationship between the full-wave rectified voltage waveform V1 corresponding to one period and the time t in the LED illuminator 70. FIG. 10B is a waveform diagram illustrating a relationship between a current I71 that flows into the first LED drive circuit 73 and the time t. FIG. 10C is a waveform diagram illustrating a relationship between a current I72 that flows into the second LED drive circuit 74 and the time t. FIG. 10D is a waveform diagram illustrating a relationship between a total current I70 and the time t. The scale of the time axis is the same in FIG. 10A to FIG. 10D. Further, the waveform in FIG. 10A is the same as that in FIG. 3A.

By using FIG. 10A and FIG. 10B, the operation of the first LED drive circuit 73 is explained. A period of time t20 is a period of time during which the full-wave rectified voltage waveform V1 is smaller than the reference voltage Vref1. During the period of time t20, the outputs of the comparators 84*a* to 84*c* are at the low level, and therefore, the FETs 86*a* to 86*c* turn off and the current I71 does not flow.

A period of time t21 is a period of time during which the full-wave rectified voltage waveform V1 is between the reference voltage Vref1 and the reference voltage Vref2, and the output of the AND element 85*a* turns to the high level, the FET 86*a* turns on, and a current flows through the current limiting circuit 87*a*, the magnitude of which is the same as that of the upper limit current thereof.

A period of time t22 is a period of time during which the full-wave rectified voltage waveform V1 is between the reference voltage Vref2 and the reference voltage Vref3. Through the current limiting circuit 87*b*, a current which is the same as the upper limit current thereof flows.

A period of time t23 is a period of time during which the full-wave rectified voltage waveform V1 is larger than or equal to the reference voltage Vref3 and a current flows through the current limiting circuit 87*c*, the magnitude of which is the same as that of the upper limit current thereof. During periods of time (period of time t24 to period of time t26) during which the full-wave rectified voltage waveform V1 decreases, the first LED drive circuit 73 follows the processes in the order opposite to that when the full-wave rectified voltage waveform V1 increases.

Through the second LED drive circuit 74 also, the current I72 having three levels flows. However, the reference voltages Vref4 to Vref6 are different from the reference voltages Vref1 to Vref3, respectively, and therefore, the timing at which the current I72 rises is set so as to differ from the timing at which the current I71 rises.

In the partial LED string 81*a*, the number of LEDs (number of stages) is set so that it is possible to cause the current I71 to flow sufficiently at the timing determined by the reference voltage Vref1 and in the partial LED string 91*a* also, the number of LEDs (number of stages) is set so that it is possible to cause the current I72 to flow sufficiently at the timing determined by the reference voltage Vref4. In the partial LED string 81*b*, the number of LEDs (number of stages) is set so that it is possible to cause the current I71 to flow sufficiently at the timing determined by the reference voltage Vref2 and in the partial LED string 91*b* also, the number of LEDs (number of stages) is set so that it is possible to cause the current I72 to flow sufficiently at the timing determined by the reference voltage Vref5. In the partial LED string 81*c*, the number of LEDs (number of stages) is set so that it is possible to cause the current I71 to flow sufficiently at the timing determined by the reference voltage Vref3 and in the partial LED string 91*c* also, the number of LEDs (number of stages) is set so that it is possible to cause the current I72 to flow sufficiently at the timing determined by the reference voltage Vref6.

The current I70 illustrated in FIG. 10D is the sum of the current I71 in FIG. 10B and the current I72 in FIG. 10C and the current I70 increases/decreases at small steps in accordance with the increase/decrease in the full-wave rectified voltage waveform V1. By causing the current I70 to increase/decrease at small steps as described above, the total harmonic distortion is reduced.

In the LED illuminator 70 illustrated in FIG. 9, it is possible to connect more LED drive circuits other than the first and second LED drive circuits 73 and 74 to the bridge rectifier circuit 11 in parallel to the first and second LED drive circuits 73 and 74. By making the switching timing of the number of serial stages of the added LED drive circuit differ from the switching timing of the number of serial stages of the first and second LED drive circuits 73 and 74, it is possible to cause the current I70 to increase/decrease at smaller steps.

In the LED illuminator 70, both the number of partial LED strings included in the first LED drive circuit 73 and the number of partial LED strings included in the second LED drive circuit 74 are set to three, but the number is not limited to this and may be set to another number. Further, the number of LEDs included in each partial LED string and the total number of LEDs included in all the LED strings are not limited to the above-described numbers and it is possible to appropriately select the numbers in accordance with the effective value or the like of the commercial AC power source that is made use of.

In the LED illuminators 10, 50, 60, and 70 described above, it is important for the timing at which the numbers of partial LED strings that emit light in each LED string switch to differ from one another. It is possible to adjust the timing at which the numbers of partial LED strings that emit light in each LED string switch by changing the number of LEDs (number of stages) included in the partial LED string and the number of partial LED strings.

Further, it is also possible to adjust the timing at which the numbers of partial LED strings that emit light in each LED string switch by changing the method of detecting the value of a current that flows through each partial LED string. For example, by making the value of the resistor 35*a* differ from that of the resistor 45*a* in FIG. 2, it is possible to adjust the timing at which the partial LED string 31*a* emits light and the timing at which the partial LED string 41*a* emits light. Further, it is also possible to adjust the timing at which the numbers of partial LED strings that emit light in each LED string switch by changing the method of detecting the voltage of the full-wave rectified waveform.

In the LED illuminators 10, 50, 60, and 70 described above, the first LED string (LEDs 33*a* to 33*e*, etc.) and the second LED string (LEDs 43*a* to 43*e*, etc.) are connected in parallel to the one bridge rectifier circuit 11. However, the LED illuminator is not limited to the case where the first LED string and the second LED string are connected in parallel to one bridge rectifier circuit. For example, it may also be possible to connect a first bridge rectifier circuit and a second bridge rectifier circuit in parallel to the commercial AC power source 12 (see FIG. 2), and to connect the first LED string to the first bridge rectifier circuit and to connect the second LED string to the second bridge rectifier circuit.

EXPLANATION OF LETTERS OR NUMERALS

10, 50, 60, 70 LED illuminator
11 bridge rectifier circuit
12 commercial AC power source
13, 53, 63, 73 first LED drive circuit
14, 64, 74 second LED drive circuit
31*a* to 31*e*, 41*a* to 41*e*, 51*a* to 51*d*, 81*a* to 81*c*, 91*a* to 91*c* partial LED string
32*a* to 32*d*, 42*a* to 42*d*, 52*a* to 52*c* bypass circuit
32*e*, 42*e*, 52*d* constant current circuit
33*a* to 33*e*, 43*a* to 43*e*, 53*a* to 53*d*, 83*a* to 83*c*, 93*a* to 93*c* LED
34*a* to 34*e*, 44*a* to 44*e*, 54*a* to 54*d* FET (depletion type)
35*a* to 35*e*, 45*a* to 45*e*, 55*a* to 55*d*, 61*a* to 61*e*, 65*a* to 65*e*, 71, 72 resistor
62, 66 current detection resistor
84*a* to 84*c*, 94*a* to 94*c* comparator
85*a*, 85*b*, 95*a*, 95*b* AND element
86*a* to 86*c*, 96*a* to 96*c* FET (enhancement type)
87*a* to 87*c*, 97*a* to 97*c* current limiting circuit
88, 98 reference voltage generation circuit

The invention claimed is:

1. An LED illuminator comprising:

a rectifier;

a first LED string connected to the rectifier and including a first partial LED string and a second partial LED string connected in series with the first partial LED string;

a second LED string connected to the rectifier in parallel to the first LED string and including a third partial LED string and a fourth partial LED string connected in series with the third partial LED string;

a first switching circuit configured to switch between a state where only the first partial LED string is connected to the rectifier and a state where the first partial LED string and the second partial LED string connected in series are connected to the rectifier as a full-wave rectified voltage waveform that is output from the rectifier increases/decreases, and a second switching circuit configured to switch between a state where only the third partial LED string is connected to the rectifier and a state where the third partial LED string and the fourth partial LED string connected in series are connected to the rectifier as the full-wave rectified voltage waveform that is output from the rectifier increases/decreases, wherein the switching timing by the first switching circuit and the switching timing by the second switching circuit are set so as to differ from each other, and a voltage applied to the first LED string by the rectifier and a voltage applied to the second LED string by the rectifier are in the same phase.

2. The LED illuminator according to claim 1, wherein the first switching circuit detects a current that flows through at least part of the first LED string and switches between a state where only the first partial LED string is connected to the rectifier and a state where the first partial LED string and the second partial LED string connected in series are connected to the rectifier in accordance with the detected current.

3. The LED illuminator according to claim 2, wherein the first switching circuit has current detection resistors for detecting a current for each of the first partial LED string and the second partial LED string.

4. The LED illuminator according to claim 2, wherein the first switching circuit has one current detection resistor for detecting a current for the first partial LED string and the second partial LED string.

5. The LED illuminator according to claim 1, wherein the first switching circuit detects a voltage of a full-wave rectified voltage waveform that is output from the rectifier and switches between a state where only the first partial LED string is connected to the rectifier and a state where the first partial LED string and the second partial LED string connected in series are connected to the rectifier in accordance with the detected voltage.

6. The LED illuminator according to claim 1, wherein a combination of the number of LEDs included in the first partial LED string and the number of LEDs included in the second partial LED string is set so as to differ from a combination of the number of LEDs included in the third partial LED string and the number of LEDs included in the fourth partial LED string.

7. The LED illuminator according to claim 1, wherein the number of serial stages of LEDs included in the partial LED string that lights up during the period of time during which the voltage of the full-wave rectified voltage waveform is the lowest between the first partial LED string and the second partial LED string is set so as to differ from the number of serial stages of LEDs included in the partial LED string that lights up during the period of time during which the voltage of the full-wave rectified voltage waveform is the lowest between the third partial LED string and the fourth partial LED string.

8. The LED illuminator according to claim 1, wherein the first LED string further includes another partial LED string and the second LED string further includes another partial LED string.

9. The LED illuminator according to claim 8, wherein the number of partial LED strings included in the first LED string and the number of partial LED strings included in the second LED string are set so as to differ from each other.

10. The LED illuminator according to claim 1, wherein the first LED string and the first switching circuit are configured as one LED module and the second LED string and the second switching circuit are configured as another LED module.

* * * * *